United States Patent [19]

Bergeron et al.

[11] Patent Number: 4,921,037

[45] Date of Patent: May 1, 1990

[54] METHOD AND APPARATUS FOR INTRODUCING DIFFERENTIAL STRESSES IN ENDLESS FLEXIBLE METALLIC CASTING BELTS FOR ENHANCING BELT PERFORMANCE IN CONTINUOUS METAL CASTING MACHINES

[75] Inventors: Norman J. Bergeron; J. F. B. Wood, both of Burlington; R. W. Hazelett, Colchester, all of Vt.

[73] Assignee: Hazelett Strip-Casting Corporation, Colchester, Vt.

[21] Appl. No.: 221,230

[22] Filed: Jul. 19, 1988

[51] Int. Cl.[5] ..... B22D 27/02

[52] U.S. Cl. ..... 164/432; 72/111; 100/151; 164/481

[58] Field of Search ..... 72/111, 161, 167; 100/151; 164/481, 432; 198/846

[56] References Cited

U.S. PATENT DOCUMENTS

| | | | |
|---|---|---|---|
| 600,359 | 3/1898 | Cox | 72/111 |
| 2,355,448 | 8/1944 | Kratz | 198/846 |
| 2,640,235 | 6/1953 | Hazelett | 164/481 |
| 2,904,860 | 9/1959 | Hazelett | 22/57.4 |
| 3,036,348 | 5/1962 | Hazelett et al. | 22/57.4 |
| 3,123,874 | 3/1964 | Hazelett et al. | 22/57.4 |
| 3,142,873 | 8/1964 | Hazelett et al. | 22/57.4 |
| 3,167,830 | 2/1965 | Hazelett et al. | 22/57.4 |
| 3,228,072 | 1/1966 | Hazelett et al. | 22/57.4 |
| 3,310,849 | 3/1967 | Hazelett et al. | 22/57.4 |
| 3,848,658 | 11/1974 | Hazelett et al. | 164/278 |
| 3,878,883 | 4/1975 | Hazelett et al. | 164/278 |
| 3,926,542 | 12/1975 | Ahrweiler | 100/151 |
| 3,937,270 | 2/1976 | Hazelett et al. | 164/50 |
| 3,949,805 | 4/1976 | Hazelett et al. | 164/278 |
| 3,963,068 | 6/1976 | Hazelett et al. | 164/278 |
| 4,002,197 | 1/1977 | Hazelett et al. | 164/250 |
| 4,062,235 | 12/1977 | Hazelett et al. | 73/159 |
| 4,082,101 | 4/1978 | Hazelett et al. | 134/127 |
| 4,487,157 | 12/1984 | Bergeron et al. | 118/59 |
| 4,487,790 | 12/1984 | Bergeron et al. | 427/422 |
| 4,537,243 | 8/1985 | Hazelett et al. | 164/481 |
| 4,588,021 | 5/1986 | Bergeron et al. | 164/432 |

FOREIGN PATENT DOCUMENTS

| | | | |
|---|---|---|---|
| 715423 | 2/1980 | U.S.S.R. | 198/846 |

*Primary Examiner*—Lowell A. Larson

*Attorney, Agent, or Firm*—Parmelee, Bollinger & Bramblett

[57] ABSTRACT

The wide, thin, revolvable, flexible, metallic casting belts are made to incorporate differential patterns of residual internal longitudinal tensile and compressive stresses. The two marginal areas are residually longitudinally stretched more than the main middle area straddled by these margins. This main middle area is used as a moving mold and is expected to contact molten metal. Thus, the treated belts have two marginal areas in a state of mild longitudinal compression straddling the main middle area in a state of mild residual longitudinal tension. During casting, when hot metal comes into contact with the main middle area of such treated belt, the main middle area expands. Because of the built-in differential compensating stresses, the stresses throughout such belt during casting advantageously become balanced or equalized across the whole belt width. This equalized stress condition during casting assures that the critical moving belt mold area will be flatter than experienced with belts not having differential stress treatment. Thus, cast metal product typically will be improved in flatness, surface finish, section uniformity, soundness and metallurgy. Two methods are described for longitudinally stretching marginal areas relative to the middle area: (A) Use a work roller effectively of larger diameter toward its end than its middle for stretching both margins relative to the main middle area; (B) Use conventional cylindrical work rollers and heat (for expanding and slacking) the middle area during roller-stretching while leaving cold margins for residually stretching both margins relative to the main middle area.

31 Claims, 6 Drawing Sheets

FIG. 3
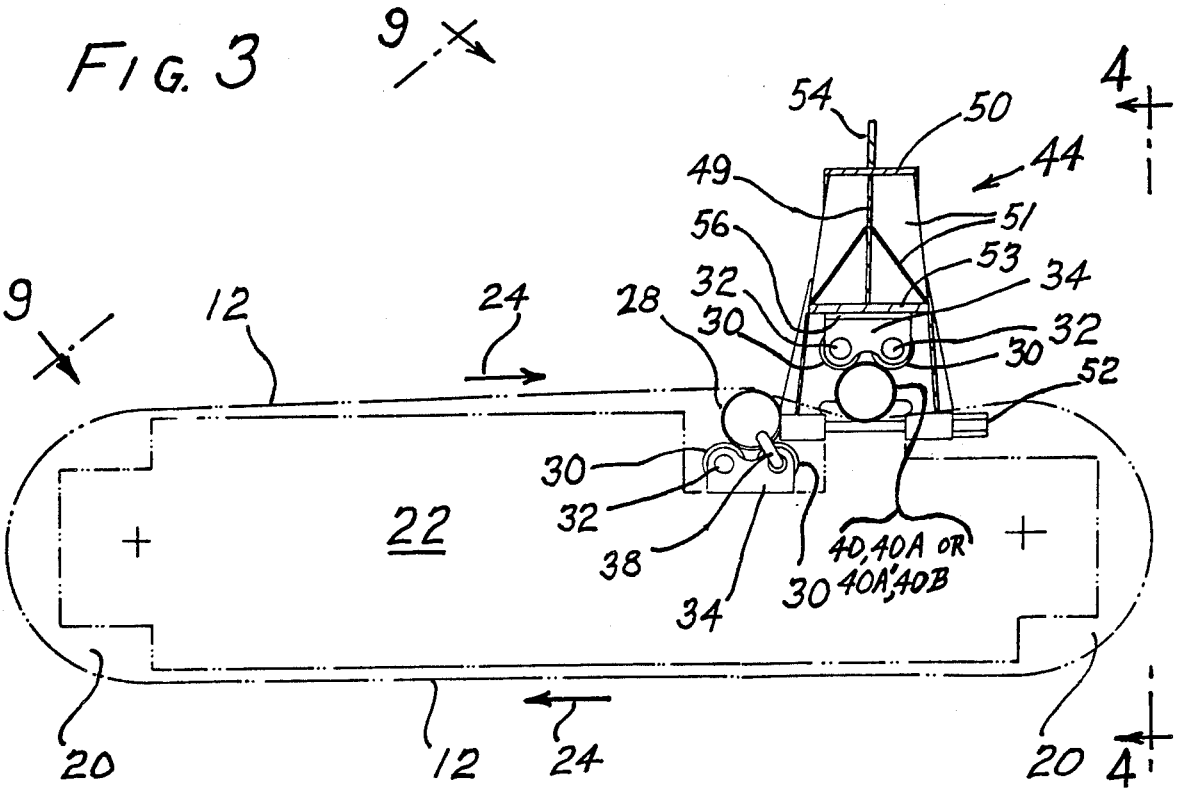
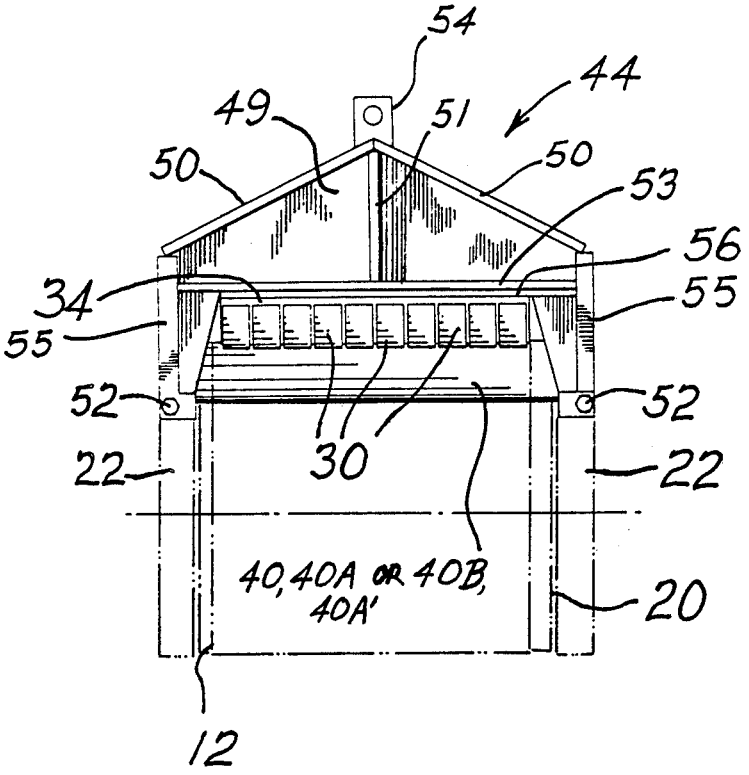
FIG. 4

METHOD AND APPARATUS FOR INTRODUCING DIFFERENTIAL STRESSES IN ENDLESS FLEXIBLE METALLIC CASTING BELTS FOR ENHANCING BELT PERFORMANCE IN CONTINUOUS METAL CASTING MACHINES

BACKGROUND

The thin, flexible, revolving endless metal casting belts intended to be employed in machines for the continuous casting of metals are normally made by cutting off a length of wide, thin, strip metal stock and then joining the cut ends by welding the ends together to form an endless casting belt of considerable width. For twin-belt continuous casting, the belts are typically required to be flattened or leveled after welding fabrication and before use, because the weld joining of the ends of the strip stock during fabrication necessitated subsequent leveling of the endless belt. Furthermore, commercial wide, thin metallic strip for use as belt stock as delivered is often not normally flat enough to use in twin-belt continuous casting machines unless the fabricated belts are leveled. This condition of being not normally flat enough is generally true with both ferrous and non-ferrous metallic belt materials.

The usual prior art method of leveling belts involved two simultaneous mechanical influences upon the belt in a process that may be called roller-stretch leveling.

The first such influence was the application of a uniform tensile force to the endless metallic belt. The belt to be leveled was placed around two (or more) pulley rolls mounted on a carriage frame. The requisite longitudinal tensile force within the casting belt to be leveled was induced by outwardly moving a pulley roll against the belt. The pulley roll was moved uniformly outwardly against the inside surface of the endless belt until the pulley roll took up the slack in the belt and forcibly tensed the belt. The tension so induced was usually in the range from one-twentieth to one-third of the yield stress of the belt material, though the roller-stretch leveling process will sometimes work suitably outside of this tension versus yield stress range.

This tensile force was not enough by itself to render the belt level. The second mechanical influence was the operation of revolving the tensed belt against and past at least one relatively small diameter, cylindrical, transversely disposed work roller. This small diameter roller deflected the course of the belt in such a way as to cause inelastic yielding elongation of the belt progressively, successively more uniformly across the full belt width as the belt repeatedly contacted and passed the small diameter roller during its revolutions. Revolving of the belt was continued until ultimately this operation stretched all areas of the belt uniformly, as desired. This small diameter work roller was cylindrical; that is, it had the same constant and uniform diameter along its entire working length.

The uniform diameter of this prior work roller was conveniently in the range from about 200 times the belt thickness to about 20 times the belt thickness, with a preferred diameter being about 60 to about 80 times the thickness of the belt being leveled. The belt thickness was typically in the range from about 0.035 to about 0.065 of an inch (about 0.9 to about 1.7 mm), though the thickness could be somewhat outside of this range.

The inelastic yielding elongation which resulted in leveling ultimately occurred essentially uniformly across the full belt width, occurring only during the continuing revolution of the belt and then only at two places along the small diameter work roller. The first inelastic yield place was along the narrow straight zone where the revolving belt first contacted and became wrapped around the work roller. The second inelastic yield place was along the narrow straight zone where the belt last contacted the roller and ceased to be wrapped upon it. The revolving tensed belt, upon entering from a straight tangent path onto the curved surface of a work roller, bent inelastically uniformly across its width into a curve which may conform, in the limit, to the shape of the roller; i.e., the mutual contact between the surface of the tensed belt and the surface of the uniform small diameter work roller produced inelastic yield in bending and elongation which ultimately became uniform across the belt width after continuing revolutions of the belt. Inelastic bending and elongation occurred again, with similar ultimate results, when the belt left the work roller to begin a new straight tangent path, since the tension in the belt forced it to resume a straight course. A second work roller was usually employed, on the opposite side of the belt, near to but not directly opposed to the first one for producing significant deflection or bending of the belt in the opposite direction from the first work roller.

In such prior roller-stretch leveling, no "rolling" of the belt material between two directly opposed pressure rolls was involved; that is, no pressure was applied whereby the belt would be squeezed in between two directly opposed rollers. Indeed, the uniform small diameter work rollers were advantageously rubber covered, in order to avoid inadvertent causing of dimples from tiny bits of debris which might adhere to the work roller and to avoid undesirable bending down of tiny asperities raised by the grit-blasting process that was performed on the outside surface of many belts prior to such uniform effect leveling. Such grit-blasting is described in U.S. Pat. Nos. 4,487,157; 4,487,790 and 4,588,021. The roller-stretch leveling was carried out subsequent to grit-blasting.

There was a "tailing-off" involved in completion of the uniform effect roller-stretch leveling during which the deflection and bending of the belt was progressively reduced for achieving an esentially uniform final condition around the full circumference of the endless belt. The final contact of the revolving belt with the work rollers should occur under conditions where the bending is minimal, i.e., when a work roller has been retracted far anough from the other roller (or rollers) to result in only slight bending of the belt as it passes by each work roller. Alternatively, the belt tension was slackened gradually during this tailing-off. The overall prior art result was that the belt was rendered both uniformly flat and practically free from residual internal tensile, compression or bending stresses, i.e., the resulting stress condition of the belt was essentially uniform across its full width and over its full endless circumference.

The essence of the prior art roller-stretch belt leveling method and apparatus was disclosed in U.S. Pat. No. 2,904,860 of C. W. Hazelett, notably in column 8, and in FIGS. 1, 2, and 4 therein. The roller-stretch belt leveling apparatus with refinements was incorporated into a number of continuous casting machines that were manufactured and sold to the metals industry by the assignee of the present patent application. Such mechanisms are indicated in U.S. Pat. No. 3,848,658 (FIGS. 1, 2 and 4); U.S. Pat. No. 3,878,883 (FIGS. 1 and 2); U.S. Pat. No. 3,949,805 (FIGS. 1 and 2); U.S. Pat. No. 3,963,068 (FIGS. 1 and 2) and U.S. Pat. No. 4,002,197 (FIG. 1), all referenced herein. In these prior roller-stretch belt-leveling mechanisms, the belt itself was under uniform tension across its width and was also at essentially the same temperature across the full width of the belt as the belt was repeatedly deflected around the cylindrical small diameter work roller during continuing revolution of the belt, so that the resultant inelastic yielding elongation which occurred ultimately became essentially uniform in effect across the full width and length of the revolving belt. The intention of the prior art was to achieve uniformity of a stress-free condition across the full belt width and along the full belt circumference.

A leveling mechanism can be mounted upon a carriage of a continuous casting machine, as illustrated in the above-listed patents. Also, separate machines for leveling of belts have been built which operate on the same principles, utilizing two or more pulley rolls around which the belt was revolved during roller-stretch leveling for achieving an essentially uniform effect across the belt width and along the belt circumference.

Whether performed on the casting machine or elsewhere, the uniform leveling of wide belts in the prior art presented the problem that the long thin uniform diameter work rollers of the desired small diameter were not rigid enough in the bending mode over their length. They would bend elastically and so spoil the desired uniformity of bending and leveling across the width of the belt. The solution was to "back up" the work rollers, i.e. to rigidly support these small diameter work rollers along their full length to prevent bending, by means of firmly and accurately positioned, rigidly mounted rotating support elements, either continuous or placed at closely spaced intervals, thereby keeping the axis of the work roller straight. Over many years, the present assignee has delivered casting machines to the metals industry that incorporated roller-stretch belt leveler apparatus based on these principles with back-up, rotating support elements for preventing bending of the small-diameter work rollers, for keeping the axis of the work roller straight.

In the prior art, the most desirable condition of belts wa presumed and intended to be that of uniform freedom from internal residual stresses, in order to allow the belts to present in the mold a flat surface to the metal product being frozen. Accordingly, the belt leveling equipment of the prior art was designed to achieve that intended uniform result across the full width of the belt. The work roller or rollers were cylindrical in shape-,—i.e. of the same constant and uniform diameter throughout the entire working region of the smooth periphery of the work roller and the belt was under uniform tension across its width and also was at essentially the same uniform temperature across the width of the belt as the belt was bent around the work roller for achieving uniformity of stress-free residual effect across the full width and along the full length of the belt.

SUMMARY OF THE DISCLOSURE

The method and apparatus embodying the present invention intentionally introduce different stresses in wide, thin, revolving flexible metallic casting belts during their manufacture (or even during their use) for enhancing performance of these novel casting belts when they are acting in the hot moving mold of a continuous metal casting machine, and particularly when these novel belts are acting in the moving mold of twin-belt casting machines.

It is to be appreciated that an ultimate objective of this invention is to achieve a substantial equality of tensile stress over the full width of each casting belt 12 (FIG. 1) in the hot moving mold region during operation of a twin-belt caster 10. This achievement of substantial equality of tensile stress over the full width of each belt is important in order to cause each belt to remain flat during casting for producing cast product having attractive uniform surface appearance and uniform metallurgical properties across its full width, i.e. cast product to have improved flatness, surface finish, section uniformity, soundness and metallurgy. The method and apparatus of the present invention intentionally introduce different residual stresses into the casting belt to compensate for the fact that the main middle area of the belt is hot in the mold region where molten metal is being solidified, while the two marginal areas of the belt remain cold.

Contrary to prior manufacturing procedures which aimed to manufacture wide, thin casting belts as nearly uniformly free as possible from residual internal stress, the method and apparatus embodying the present invention make such belts in a novel condition with mild residual longitudinal compression stress in their two marginal area and with mild residual longitudinal tension stress in their main middle area (casting area). When such a novel casting belt is employed in a casting machine, the hot metal being cast in the moving mold causes the main middle area of the casting belt to become heated and expanded relative to the two marginal areas. Thus, advantageously the stresses throughout such a novel casting belt in the vicinity of the hot moving mold tend to become equalized. This hot-mold, equalized-stress condition assures that the present casting belts will be flatter in the moving mold than experienced or obtained with prior belts. The final result will be that the cast metal product typically will be improved in flatness, surface finish, section uniformity, soundness and uniformity of metallurgy.

The two "marginal areas" are normally of substantial width in relation to the overall total width of a casting belt in current twin-belt casting machine practice. Each "marginal area" is normally not less than about 4 inches (100 millimeters) wide. That is, each "marginal area" extends inwardly not less than about 4 inches from the very edge of the belt. These two marginal areas straddle the "main middle area" (casting area of the belt).

In accordance with the present invention, there are two methods described for manufacturing these novel casting belts having mild residual longitudinal compression stress in the two marginal areas and having mild residual longitudinal tensile (tension) stress in the main middle area. Both of these methods may be called "differential-stress, roller-stretching of wide, thin, flexible, metallic casting belts".

As used herein, the term "hour-glass shape" is intended to include the shapes shown in FIGS. 6, 6A, 7, and 8B and the contoured bent axis roller of FIG. 7A. Such an "hour-glass shape" is symmetrical about a transverse bisecting plane, being larger at each end than at the middle, and with essentially no reversal in the sign of the mechanical slope from the bisecting plane out to each end of the work roller. The temperature profile of FIG. 8A also has an "hour-glass shape" as defined above.

As applied to a casting belt herein, the term "wide" is intended to include the range from about 22 inches in width to about 80 inches in width, or more, as desired by the customer or user.

The term "thin", as applied to a casting belt herein, is intended to include the range in thickness from about 0.030 of an inch up to about 0.080 of an inch, not including belt coating or belt dressing.

(A) First Method: During differential-stress, roller-stretch treatment one, or more, work rollers is employed that is not cylindrical in shape but is slightly larger in diameter toward each end of its working length as compared with the middle portion of its working length. In other words, at least one work roller is somewhat hour-glass shaped (or, alternatively, its axis is intentionally caused to assume a predetermined hour-glass shape curve) for stretching both marginal areas of the casting belt relative to the main middle area of the belt. Thus, the main middle area of the endless casting belt becomes somewhat shorter in circumferential length than the two marginal areas. Consequently, the main middle area of the novel belt has mild residual longitudinal tensile or tension stress therein, while the two marginal areas have mild residual longitudinal compressive or compression stress therein.

In the resulting novel belt, the mild residual longitudinal tensile stress in the main middle area of the endless belt is trying to reduce the circumferential length of the belt, while the mild residual longitudinal compressive stress in the two marginal areas of the endless belt is trying to increase the circumferential length of the belt. In some of these novel belts, the residual longitudinal compressive stress in the two marginal areas might attempt to relieve itself by causing transverse rippling of the marginal areas. In the absence of such rippling, a visual inspection of these novel belts would not be likely to reveal their residual differential longitudinal stresses. This rippling of the marginal areas disappears when the belt is placed under tension in a casting machine.

(B) Second Method: During differential-stress, roller-stretch treatment, the main middle area of the endless casting belt is heated just prior to bending by the work roller for causing the main middle area to expand in circumferential length relative to the two marginal areas. Then, work rollers of constant uniform diameter along their entire working length are usually employed for stretching both marginal areas of the belt relative to the main middle area of the belt. (Hour-glass shaped or curved axis work rollers may also be used.) Consequently, when the main middle area of the novel belt cools, it has mild residual longitudinal tensile or tension stress therein, while the two marginal areas have mild residual longitudinal compression stress therein.

As explained under section (A) above relating to the first method, the mild residual longitudinal tensile stress in the main middle area of the resulting novel belt produced by this second method (B) is trying to reduce the circumferential length of the belt, while the mild residual longitudinal compressive stress in the two marginal areas of the belt is trying to increase the circumferential length of the belt. In some of these novel belts, the residual compressive stress in the two marginal areas might attempt to relieve itself by causing transverse rippling of the marginal areas, but otherwise visual inspection would not be likely to reveal their differential longitudinal stresses. This rippling of the marginal areas disappears when the belt is placed under tension in a casting machine.

The first method (A) or the second method (B) may be carried out on a twin-belt casting machine during casting by differential-stress, roller-stretching the upper and lower revolving belts of the twin-belt machine during their return travel from the downstream (outlet or discharge) end of the machine to the upstream (inlet or entrance) end of the machine. In particular, the second method (B) which involves the heating mode using radiant heaters is convenient for adjusting the differential stress conditions within the respective belts during operation of the casting machine, because the amount of radiant heating is relatively easy to adjust by adjusting the energy input (either gas fuel or electrical power) being supplied to the radiant heaters.

BRIEF DESCRIPTION OF THE DRAWINGS

The various features, aspects, objects and advantages of the present invention will become more fully understood from a consideration of the following detailed description of the presently preferred embodiments of the invention, together with the accompanying drawings, which are not drawn to scale but rather are arranged to clearly illustrate the present invention, and wherein corresponding reference numerals are used to indicate corresponding elements throughout the various views.

FIG. 2 is similar in several respects to FIG. 8 of U.S. Pat. Nos. 3,937,270, 4,062,235 and 4,082,101.

FIG. 3 is a side elevational view of differential-stress, roller-stretching apparatus for treating casting belts for enhancing their performance This apparatus may be mounted upon a continuous casting machine as shown in FIG. 1, or may be incorporated into a separate machine for treating belts.

FIG. 4 is an end elevational view of the apparatus of FIG. 3, as seen from the position 4—4 in FIG. 3.

DETAILED DESCRIPTION OF PREFERRED EMBODIMENTS OF THE INVENTION

Figure 1:
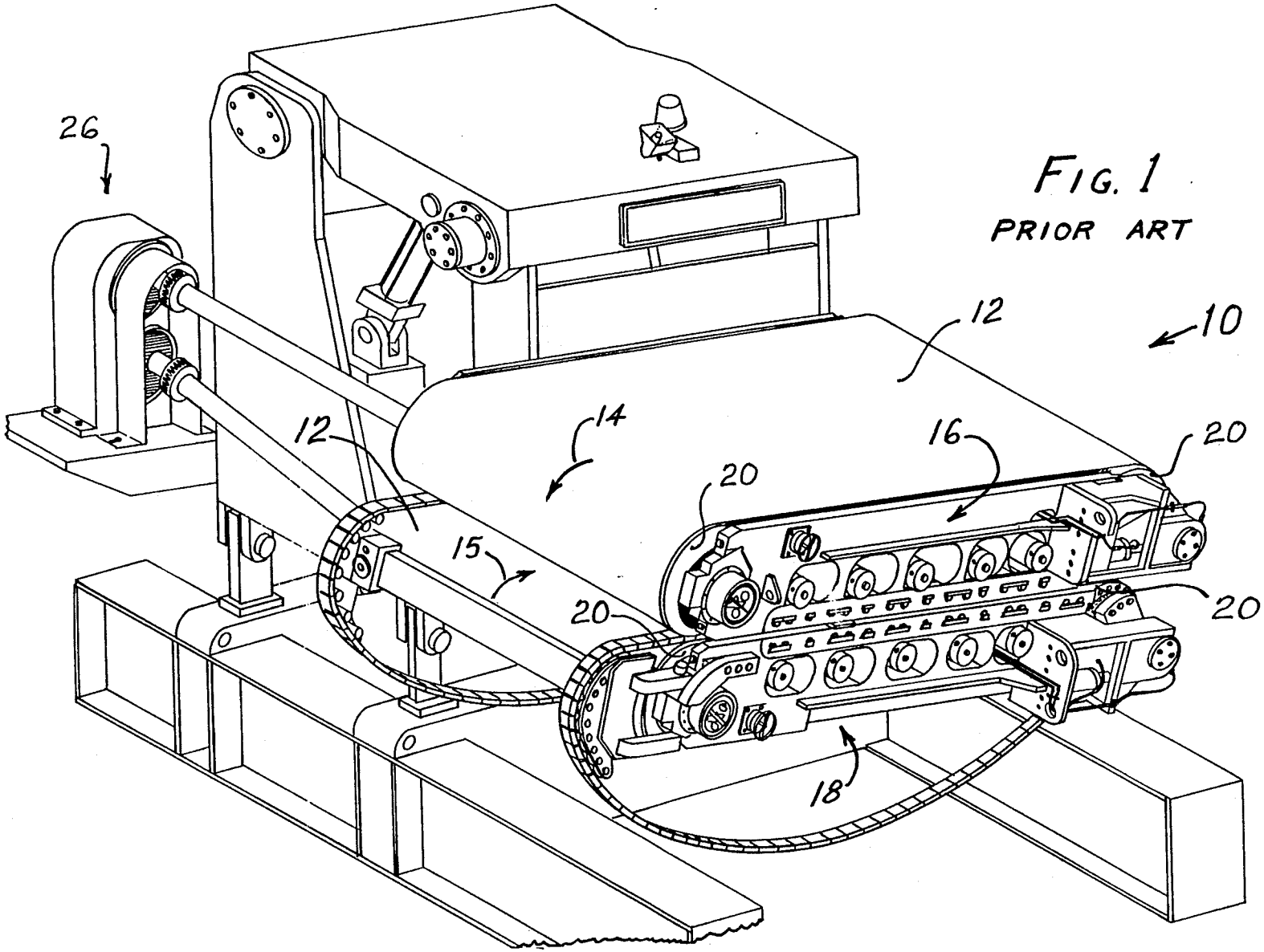
FIG. 1 PRIOR ART
FIG. 1 is a perspective view of a prior art twin-belt continuous metal casting machine employing upper and lower wide, thin, revolving, endless, flexible, metallic casting belts whose performance is enhanced by employing the present invention.

In prior art twin-belt continuous casting machine 10 (FIG. 1), there are wide, thin, upper and lower flexible, metallic casting belts 12 revolving as shown by arrows 14 and 15, respectively, around upper and lower belt carriages 16 and 18. For detailed information regarding the structure and operation of such twin-belt continuous casting machines, the reader may refer to the patents listed in the introduction owned by the assignee of the present invention and this patent application. The disclosures of these patents are incorporated herein by reference. The performance of each belt 12 is enhanced by employing the present invention, as will be explained later.

Figure 2:
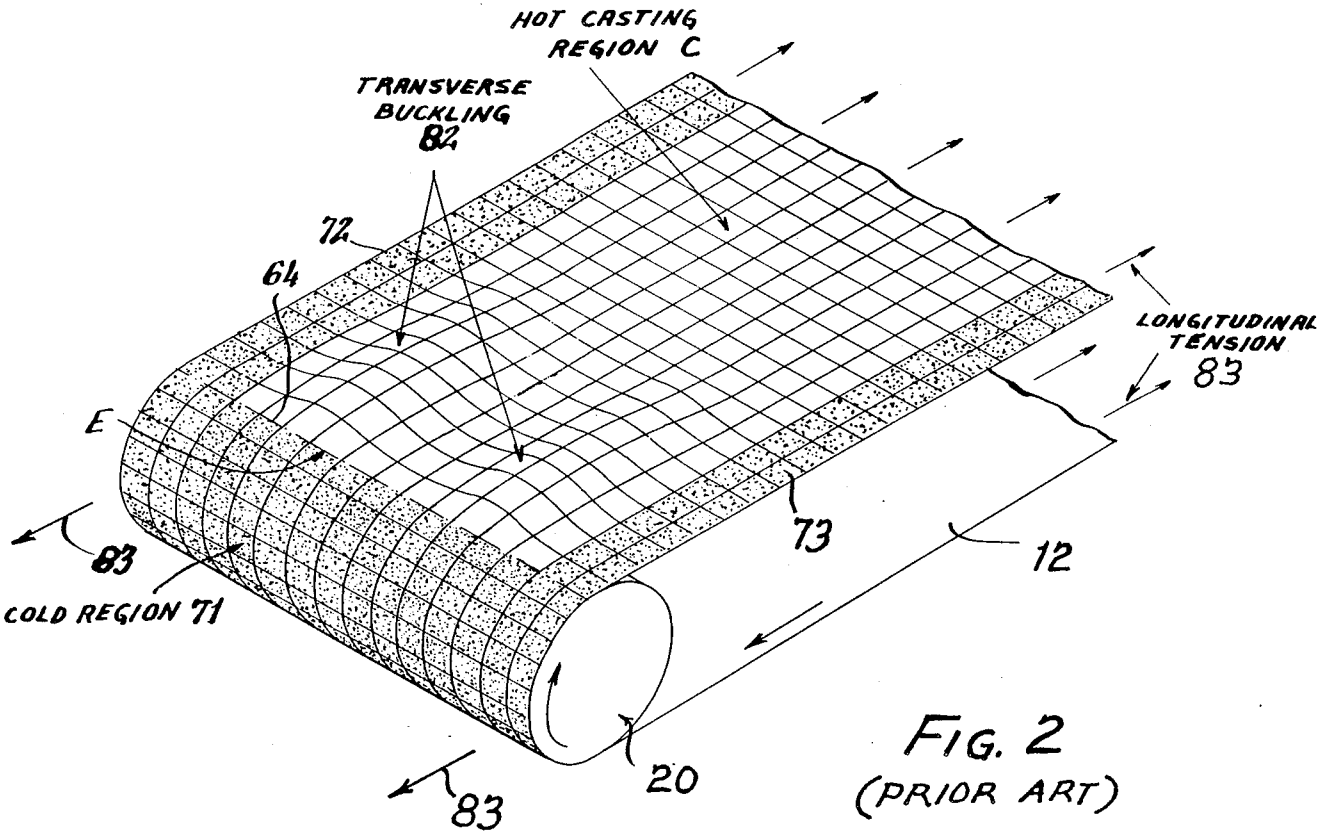
FIG. 2 (PRIOR ART)
FIG. 2 is a perspective view of a lower casting belt in such a machine for illustrating the problems being overcome or substantially reduced by the present invention.

FIG. 2 will be referred to later for explaining the problems advantageously overcome or substantially reduced by the present invention.

As shown in FIG. 3, a casting belt 12 to be differential-stress roller-stretched is revolved around end pulley rolls 20 which are supported by a frame 22. This frame 22 may be a carriage frame of an upper or lower carriage 16 or 18 (FIG. 1) of a twin-belt continuous casting machine 10, or may be the frame of an independent belt treating machine. Mechanism for applying force to one of the pulley rolls 20 in order to apply tension to belt 12 is not shown, but such belt tension mechanism may be similar to any of the various mechanisms shown in U.S. Pat. Nos. 2,640,235; 2,904,860; 3,036,348; 3,123,874, 3,142,873; 3,167,830; 3,228,072; 3,310,849; 3,878,883; 3,949,805 or 3,963,068.

Figure 5:
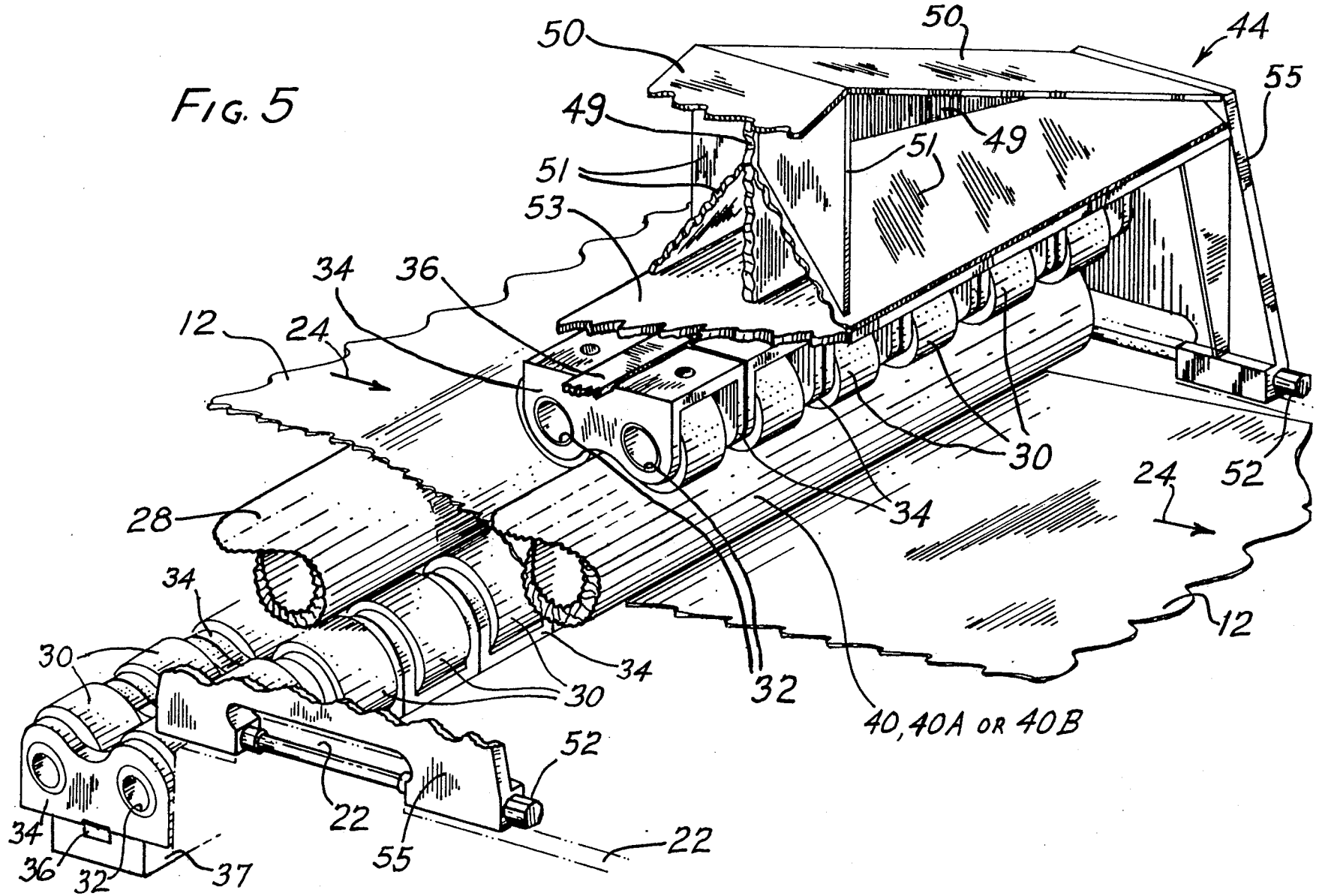
FIG. 5 is a perspective view, shown partially broken away, of the apparatus of FIGS. 3 and 4.

For revolving the belt 12 in the direction of the arrows 24, one of the end pulleys 20 is mechanically rotated, for example, by drive means such as shown at 26 in FIG. 1. The belt 12 travels in the direction indicated by arrows 24 over a work roller 28 shown, for example, as a metallic tube about 4 inches (100 mm) in diameter, cylindrical in shape. This work roller 28 is nested directly against two rows of roller back-up bearing elements 30. Shafts 32, here made of tubing, hold the rotatable back-up bearings 30 in place in a row of support bearing blocks 34, which are precisely positioned by means of key 36 (FIG. 5) to a rigid frame member 37 which is usually a welded and machined portion of frame 22. A loose-fitting keeper rod 38 prevents the escape of the work roller 28. Each work roller often is coated with a moderately hard rubber layer, as discussed in the introduction, such layer being normally in the range of about 0.10 to about 0.40 of an inch in thickness.

Figure 6:
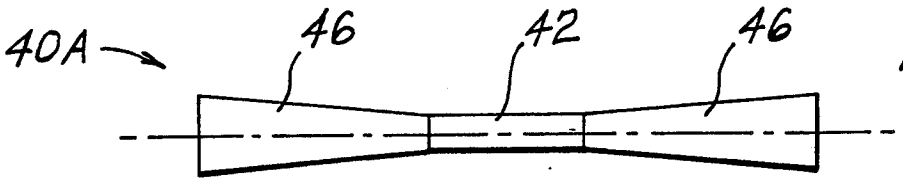
FIG. 6 is an elevational view of a differential-stress, roller-stretch working roller hour-glass shape contoured with a central cylindrical zone straddled by two conically tapered end zones in accord with the present invention in certain of its aspects. The conical tapers are shown exaggerated for clarity of illustration.
Figure 6A:
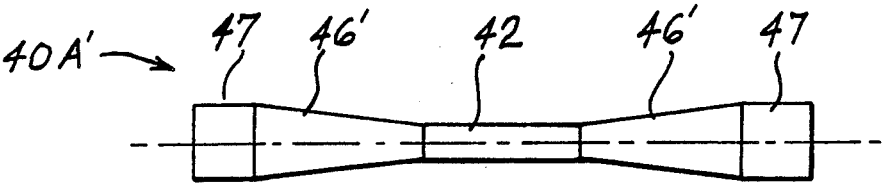
FIG. 6A shows a modification of the work roller of FIG. 6.

The belt 12 next passes under another work roller 40 or 40A or 40A', or 40B which may be cylindrical or non-cylindrical, depending upon whether the first method (A) or second method (B) is being employed. In using the first method (A), the work roller 40 may have the non-cylindrical shape as shown at 40A in FIG. 6, 40A, in FIG. 6A, or 40B in FIG. 7. The differential-stress, roller-stretch work roller 40A is symmetrical; it is contoured with a central cylindrical section 42 straddled by two conically tapered end sections 46, whose tapers are shown exaggerated for clarity of illustration. In FIG. 6, the cylindrical section 42 is shown as having an axial length in a range from about 50% to about 80% of the axial length of either of the two identical tapered end sections 46. It is to be understood that the length of this cylindrical central section 42 may be varied over a wider range than the above example to suit circumstances.

Figure 7:
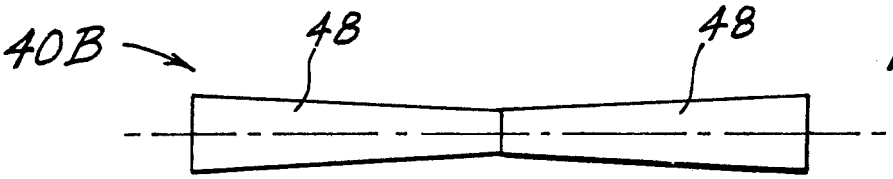
FIG. 7 is an elevational view similar to FIG. 6 showing a modified differential-stress, roller-stretch working roller contoured with two conically tapered halves. The conical tapers are shown exaggerated for clarity of illustration.

For example, in FIG. 7, the work roller 40B does not include a cylindrical central section, and the two conically tapered end sections 48 meet at the middle of this work roller 40B. Thus, the full range of the axial length of the cylindrical central section 42 as compared with the axial length of either of the tapered end sections 46 or 48 is from zero percent to about 90%.

The work rollers 40A and 40B are larger in diameter at each end than in the middle. For example, this differential in diameter is preferred to be in the range from about 0.06 of an inch (about 1.5 mm) to about 0.12 of an inch (about 3 mm) in the situation of a work roller 40A or 40B having a working length of about 6 feet (about 72 inches, about 1830 mm). It is to be understood that work rollers 40A or 40B having a shorter working length will have a proportionately smaller differential in diameter between the end and the middle, so that the steepness of the taper of the truncated conical end sections 46 or 48 remains about the same.

Experiments have suggested that belts 12 of narrower width than the working length of the roller 40A or 40B can succesfully be differential-stress roller-stretched using longer work rollers than the width of the belt 12, provided that the narrower belt 12 is centrally (symmetrically) positioned against the longer work roller 40A or 40B.

It is to be understood that another contour 40A' (FIG. 6A) for the work roller 40A is possible. For example, the outer end portion of each tapered section 46 is made cylindrical as shown at 47 in FIG. 6A, and then the truncated conical tapered sections 46' are made to have a proportionately steeper taper. At the present time, the work roller shapes of FIGS. 6 and 7 are more preferred than the shape of FIG. 6A.

In order to support the work roller 40, 40A, 40A' or 40B, there is a rigid support assembly 44 (FIGS. 3 and 4), which is shown as having the shape of a gable-ended roof, being a welded assembly of rigid steel plates including a transverse web 49, sloping roof-like flange plates 50, gussets 51 and a base plate 53. The assembly 44 also includes end walls 55. The work roller 40, 40A, 40A' or 40B is backed up by rotatable bearing elements 30 having shafts 32 and mounted in bearing blocks 34. Despite the fact that the work roller 40A or 40B is not cylindrical, the taper is so slight that it readily nests against its support bearing elements 30 under the force of the deflected taut belt 12.

Figure 7A:
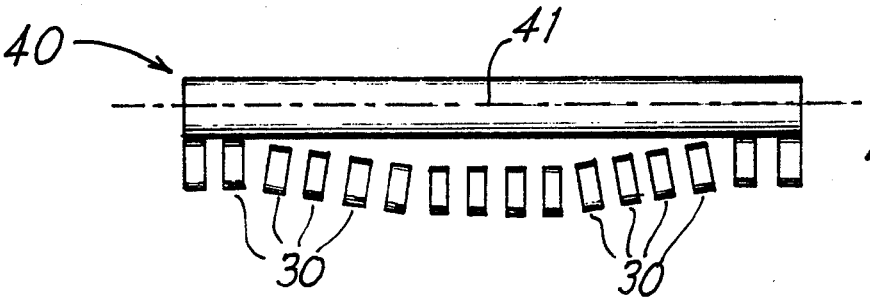
FIG. 7A shows an alternative arrangement for achieving in effect an hour-glass shape curve in the work roller.

The purpose of the roller shapes 40A, 40A' or 40B is to increase the length of the belt path in the belt marginal areas more than in the main middle area during work roller stretching and hence to stretch the marginal areas relatively more, thereby producing mild residual longitudinal compressive stress in the marginal areas and mild residual longitudinal tensile stress in the main middle area, when the belt has been released from treatment. An alternative arrangement for achieving a similar effect is shown in FIG. 7A, namely, to use a cylindrical work roller 40 having numerous support bearing elements 30 arranged along a desired predetermined hour-glass shape curve. These bearing elements 30 thus cause the axis 41 of this work roller to assume an hour-glass shape curve corresponding to the curved pattern defined by the support elements 30 in FIG. 7A. Belt tension causes the work roller axis 41 to be deflected as the work roller 40 seats against its supports 30.

As shown, the support assembly 44 is attached to the machine frame 22 by two pivot pins 52. When such a rigidly mounted assembly 44 is employed, the belt tension is preferably relaxed during tailing-off of the treatment in order to avoid kinking or other non-uniformity in the belt 12. A removable shim 56 may be employed to facilitate adjustment of the work roller 40, 40A, 40A' or 40B toward or away from the belt 12. In other words, this shim 56 serves as belt-deflection adjustment means for adjusting the elevation of the second work roller 40, 40A, 40A' or 40B relative to the first work roller 28. It is to be understood that other belt-deflection adjustment means may be employed, for example, the vertical position of the whole assembly 44 can be adjusted relative to the machine frame 22 by mean of shims (not shown) or vertical feed screws (not shown) or tapered wedges (not shown). In summary, it is desirable to have belt-deflection adjustment means 56 for adjusting the elevation of the second work roller 40, 40A, 40A' or 40B relative to the first work roller 28, but the particular nature of such belt-deflection adjustment means is not critical. A pad eye 54 may be provided at the top center of the assembly 44 for conveniently lifting this assembly by means of a hoist. The belt-deflection adjustment shim 56 is omitted from FIG. 5. When such shim is inserted, it is inserted below the base plate 53 and above the bearing blocks 34.

The first method (A) and the apparatus as described so far may result in a slight transverse or cross-sectional concave bow—i.e., transverse residual stress—of the casting belt 12 as a result of residual longitudinal tension in the outer surface. This tension would be induced by the last work roller 28, 40, 40A, 40A', or 40B to be contacted by the belt, and this roller is normally outside the belt. The cross-stress results from the fact that, in metals, elastic strain in one direction tends to produce some elastic strain at right angles, a fact that Poisson's ratio formalizes. The resulting mildly concave outer surface of the belt condition is desirable for the achieving of flatness of the belt during casting, since the molten metal will heat up the tensed outer face of the belt and so tend to straighten it.

It is to be understood that both the first and second work rollers 28 and 40, 40A, 40A' or 40B can be contoured, if desired, for achieving various differential-stress effects in the belt 12.

Figure 9:
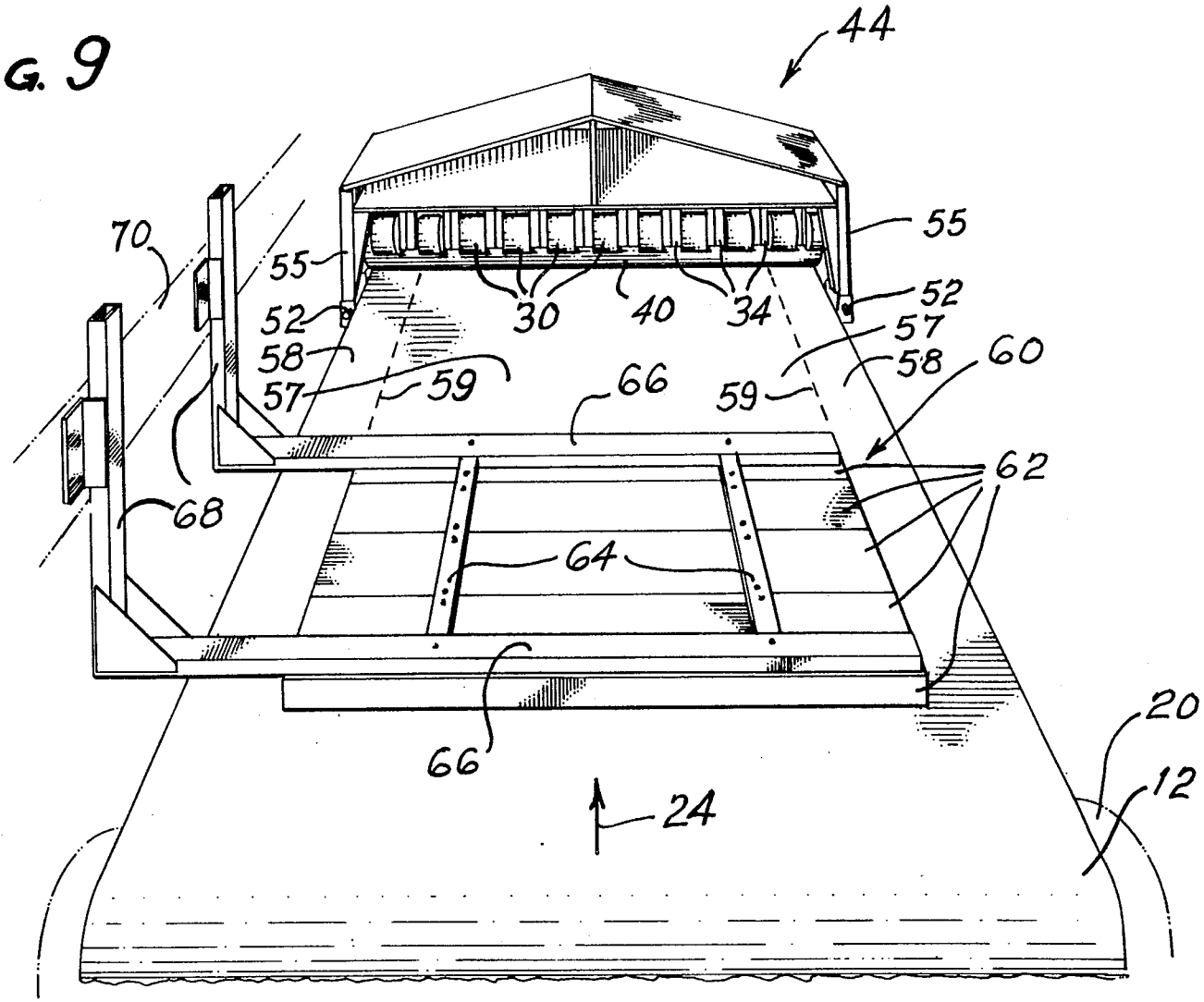
FIG. 9 is a perspective view as seen looking downwardly and forwardly from the position 9—9 in FIG. 3 showing the utilization of radiant heaters positioned over the main middle area of the belt in accordance with the second method (B) discussed above in the SUMMARY OF THE DISCLOSURE.

For explaining the second method (B), reference will now be made to FIGS. 3 and 9. The belt 12 is revolved in the direction 24, and as the belt is moving toward the first work roller 28, but before the belt reaches this first work roller 28, its main middle area 57 is heated, but its marginal areas 58 are not heated. The main middle area 57 is located between the parallel dashed lines 59. This heating is preferably accomplished by radiant heating means 60, for example, comprising a plurality of radiant gas fueled or electric powered heaters 62 attached to support straps 64 carried by a pair of arms 66 mounted on brackets 68 secured to an attachment 70 to the frame 22

The width of the main middle area 57 so heated is no more than about the width of the product to be cast later on the belt 12. The heated belt almost immediately passes over work roller 28 and then under work roller 40, which is shown as cylindrical. (There is no reason, except for avoidance of complexity, why the work roller 40 could not be contoured like work roller 40A, 40A' or 40B, thereby partaking of both the first and second methods (A) and (B) of the invention at once.)

In order to explain this method (B), it is assumed that the belt 12 is initially at 80 degrees F. when the differential stress treatment is commenced, and it is then heated in the middle area 57 to 145 degrees F., thereby creating a thermal differential of 65 degrees F. between the middle area 57 and the marginal areas 58. This differential of 65 degrees F. is maintained while the belt passes the work rollers. In a steel belt, the resulting unit expansion occurring during the treatment is about 0.0004 inches per inch (or millimeters per millimeter). (The coefficient of thermal expansion of steel is about 0.0000062" per inch per degree F. Thus, a 65 degree F. rise in temperature produces the above-described unit expansion of about 0.0004 of an inch per inch. Since the modulus of elasticity is 30,000,000 pounds per square inch, a strain of about 0.0004 of an inch equals a stress of about 12,000 pounds per square inch.) In a steel belt that is flat or held flat, this corresponds to a longitudinal stress difference of about 12,000 pounds per square inch of cross-sectional area, which is a significant amount. This amount of temperature differential is easily attained. Thus, in this example, the marginal areas 58 experience about 12,000 pounds more longitudinal tensile stress per square inch of cross-sectional area than the main middle area 57, and consequently, the marginal areas 58 become roller-stretched more than the heated (somewhat slackened) main middle area 57. Therefore, when the whole belt is again at the initial temperature of 80 degrees F., the main middle area 57 has a residual longitudinal tensile stress therein while the marginal areas 58 have a residual longitudinal compressive stress therein, as desired. The stress (or strain) differential in this typical example will in reality be substantially less than 12,000 pounds per square inch (or 0.0004 inches/inch of strain), since the heated middle portion of the belt will cool somewhat before it can be brought against the work roller or rollers. Additionally, contact with a work roller will remove some heat as the belt goes past it. The amount of such reduction in temperature has not been determined but is believed never to amount to more than half the differential in temperature. Thus, the resultant differential in residual longitudinal stress in the treated belt is at least 6,000 pounds per square inch.

Figure 8A:
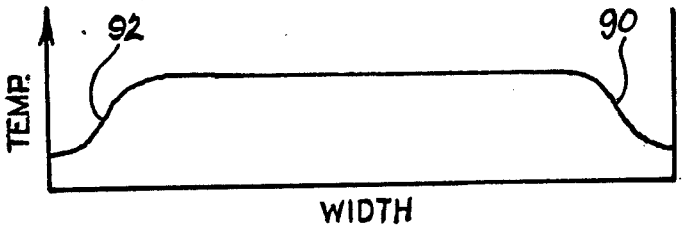
FIG. 8A shows a temperature profile, transversely across the casting belt, that may occur in the heating that accompanies thermal differential stress treatment, using the apparatus shown in FIG. 9.
Figure 8B:
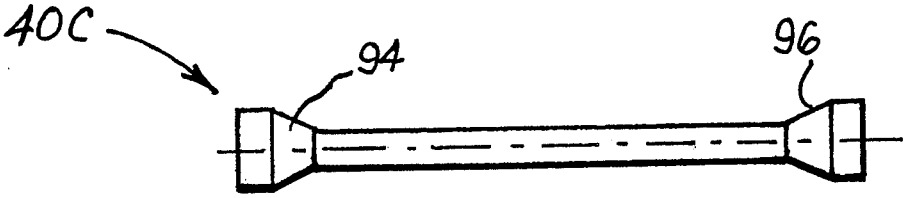
FIG. 8B shows an extreme, hypothetical modification of the work roller of FIG. 6A for purposes of explanation in association with FIG. 8A.

FIG. 8A shows a transverse profile of temperature across the casting belt 12 that is normally experienced during employment of the second method (B) with radiant heating. The profile of FIG. 8A corresponds to what a hypothetical roller 40C (FIG. 8B) might be expected to produce by the first method (A), since the transitional areas 90 and 92, respectively, are of about the same width and in the same transverse positions. However, in method (A), a roller with such an abrupt mechanical transition as at 94 and 96 is not now used since, in our experience to date, it tends to wrinkle and traumatize the belt material through shear stress, while the thermal method (B) with equivalently shaped transitional areas 90 and 92 has less tendency to do so. Our explanation of this better performance of the second method (B) in this instance is that the belt exits from the thermal leveling apparatus hot, and free from differential stresses, insofar as cylindrical rollers are used. The differential stresses arise all around the circumference of the belt only while the belt is cooling, a situation conductive to gradual and uniform application of differential stress. This full circumferential effect is in contrast to what can be locally obtained with work rollers shaped abruptly as 40C.

This unique, advantageous full circumferential effect (universal simultaneous effect) of the second method (B) just discussed is not obtained when contoured rollers are employed in conjunction with non-uniform radiant heating of the belt.

Either the first method (A) or the second method (B) can be employed on a twin-belt casting machine 10 (FIG. 1) during the casting process. In this way, fine-tuning adjustments to the differential residual stresses in each belt 12 are readily made on the revolving casting belt in response to the needs of a particular cast, as determined by inspection of the exiting slab or product, as soon as the cast is under way and the casting speed has become stabilized. The second method (B) of heating the belt as shown in FIG. 9 is especially convenient and flexible for use on a casting machine during casting since only the intensity of heat from the radiant heating means 60 need be varied, and that adjustment in radiant heating can readily be done by means of gas fuel flow control valves, or electrical energy control switches or variable transformers.

As explained above in the SUMMARY OF THE DISCLOSURE, either the first method (A) or the second method (B) may result in that the residual longitudinal compressive stress in the two marginal areas 58 may attempt t relieve itself by causing transverse rippling of these marginal areas. When such a belt with rippled margins is placed under tension in a twin belt caster 10 (FIG. 1) the marginal rippling disappears.

WHY WE BELIEVE THIS INVENTION WORKS

The following is an explanation of our theory of the reasons why this invention works so well. Regardless of whether or not this theory is correct, our experiments have shown that a dramatic improvement in performance is achieved by employing the present invention.

Reference will now be made to FIG. 2 which illustrates the "cold-framing" phenomenon that occurs in twin-belt continuous casting. An explanation of the cold-framing phenomenon is set forth in U.S. Pat. No. 3,937,270, especially in columns 7 and 8 with reference to FIG. 8 in that patent. The disclosure of that patent is incorporated herein by reference. In the present application, FIG. 2 corresponds somewhat with FIG. 8 of that patent. The stippled areas 71, 72 and 73 indicate the "cold frame" of a lower casting belt. The areas 72 and 73 extending along the two edges of the belt in FIG. 2 are "marginal areas" and correspond in size with the marginal areas 58 in FIGS. 8 and 9.

In the earliest prior art, this "cold frame" nearly surrounded the main middle area 57 (the hot casting region C) of the belt. This main middle area C was heated by the hot molten metal being solidified, while all of the stippled areas 71, 72, 73 remained cold. As a result, deformations and buckling 82 occurred.

In the more recent prior art, belt preheating, as described in U.S. Pat. Nos. 3,937,270 and 4,537,243, removed the coldness of the belt in the middle region 71 of the belt in advance of the entrance into the mold, and hence such belt preheating relieved much or most of the transverse cold-framing occurring in the middle area 71 in advance of the entrance into the mold.

However, belt preheating or belt heating was not at all effective along the cold margins 72 and 73, because the huge flows of high velocity coolant water which are employed in twin-belt casting machines of practical design are not confined just to the reverse surface of the belt adjacent to the casting area C, but these huge flows of coolant water cascade out over the belt margins. Hence during casting operation, the marginal areas 72 and 73 are kept cool by transversely exiting coolant flow along both margins of the moving mold. Thus, these marginal areas 72 and 73 remain as cold-framing elements, resisting the expansion of the hot main middle area 57 (hot casting region C) which is being heated by enormous heat flux coming from solidifying molten metal. As a result of this cold-framing condition, the cold marginal areas 72 and 73 bear (carry) a disproportionately large share of the circumferential belt tension 83 being applied to the belt by the entrance pulley roll 20 and the exit pulley roll 20 (FIG. 1), while the main middle area 57 being slightly thermally expanded does not experience the necessary tension for keeping it flat. As a result, the cast metal product issuing from the moving mold does not exhibit desired flatness, surface finish, nor uniform metallurgy.

By virtue of the present invention, which causes the main middle area 57 of the belt to have residual longitudinal tensile (tension) stress while the marginal areas 58 have residual longitudinal compressive (compression) stress, this novel belt in the hot moving mold region experiences the desired necessary tension in the main middle area for keeping the belt flat, because the thermal expansion of the main middle area is compensated in whole or in part by the residual compressive stress that was manufactured into the marginal areas, i.e. is offset in whole or in part by the fact that the marginal areas have a slightly greater circumferential length. Thus, the thermal expansion of the main middle area in the hot moving mold region causes the main middle area now to have the same circumferential length in the hot moving mold region as the marginal areas, so that the main middle area 57 experiences the necessary tension for keeping it flat in the moving mold, thereby producing an enhanced cast metal product issuing from the moving mold having improved flatness, improved surface finish, improved section uniformity, soundness and improved uniformity of metallurgy.

FURTHER DETAILED SPECIFICATION

Inviting attention again to FIGS. 6, 6A and 7, it is to be noted that these hour-glass shaped work rollers 40A, 40A' and 40B during operation nest against the pairs of support bearing elements 30 which are aligned along two straight parallel lines. The force of the deflected taut belt 12 causes the central portion of the hour-glass shape work roller 40A, 40A' or 40B to deflect toward nesting relationship against these two straight parallel lines of bearing elements 30. Due to this deflection of the nested hour-glass shaped work roller, its hour-glass shape taper in its exposed side, i.e. on its side opposite to these bearing elements 30, is effectively about doubled, and the tensioned belt is being work-roller stretched by this exposed side of the work roller. Thus, whereas the actual preferred differential in diameter between each end and the center of a 72 inch long work roller is in the range from about 0.06 of an inch to about 0.12 of an inch, the effective differential in diameter between an end and the center lies in the range from about 0.12 of an inch to about 0.24 of an inch due to that deflection of the work roller into its nest of pairs of straight-aligned bearing elements 30. The average change in diameter per foot of length of the straight work roller is in the range from about 0.02 of an inch per foot to about 0.06 of an inch per foot. When the work roller is deflected into nested relationship, this range of change in effective diameter is from about 0.04 of an inch per foot of work roller length to about 0.12 of an inch per foot.

The increase in path length at the edges of the belt 12 being leveled is readily calculated geometrically. However, this calculation is not itself helpful in predicting the desirable change in effective diameter of the work roller, since the strain so induced is spread and attenuated non-uniformly over an area before and after (upstream and downstream of) the shaped work roller 40A, 40A' or 40B. Finite-element analysis would be needed to quantify this matter, and we have not found reason to do this; our empirical methods have been successful.

With reference to FIG. 7A, causing a straight cylindrical work roller 40 to have an effective hour-glass shape comparable to a nested hour-glass shape work roller 40A, 40A' or 40B calls for the bearing elements 30 be arranged for deflecting the axis 41 in FIG. 7A by an amount of about 0.04 of a inch to about 0.12 of an inch per foot of length of the axis 41.

Since welding of the ends of the cut metal sheet soften the adjacent sheet metal and often also leave a soft weld due to heating, it is desirable to restore the hardness of the adjacent metal and to harden the weld itself by local cold working of the weld and of the adjacent sheet metal. Such local cold working is accomplished by skillful hammering, but in wide belts it is more expediently accomplished by roller planishing.

As used herein, the term "an in-the-moving-mold-belt-flattening-enhancement-effective amount of differential between residual longitudinal tensile stress in the main middle area of the belt and residual longitudinal compressive stress in the two marginal areas of the belt" is intended to mean that there is sufficient differential in such stress in the belt for causing the treated belt to remain flatter in a moving mold when the main middle area of the belt is heated by molten metal than occurs employing a prior art belt of similar size and material operating in a similar moving mold for continuously casting the same metal.

As used herein, the term "continuously-cast-product-surface-finish-enhancement-effective amount of differential between residual longitudinal tensile stress in the main middle area of the belt and residual longitudinal compressive stress in the two marginal areas of the belt" is intended to mean that there is sufficient differential in such stress in the belt for causing a continuously cast product issuing from the moving mold to exhibit a better surface finish than exhibited by a cast product issuing from a similar moving mold employing a prior art belt of similar size and material continuously casting the same metal into a cast product.

Although the invention has been described with particular reference to twin-belt casting machines it is believed that this invention will enhance the operation of any of the various types of casting machines which use at least one endless flexible metallic casting belt for forming at least one moving wall of a moving mold for continuous casting of molten metal.

Although specific presently preferred embodiments of the invention have been disclosed herein in detail, it is to be understood that these examples have been described for purposes of illustration. This disclosure is not to be construed as limiting the scope of the invention, since the described apparatus and methods may be changed in details by those skilled in the art, in order to adapt these apparatus and methods of casting metal shapes to be useful in particular continuous casting machines or situations, without departing from the spirit and scope of the invention as claimed in the following claims and equivalents thereof.

We claim:

1. In the treatment of a wide, thin, endless, flexible, metallic casting belt adapted to be revolved under tension for travelling through a moving mold and having a main middle area for providing a moving wall in the moving mold for continuous casting of hot molten metal in the moving mold, said main middle area being straddled by two marginal areas, and wherein the main middle area of the casting belt becomes heated by the molten metal, causing the main middle area to expand and slacken in the moving mold relative to the two marginal areas, thereby causing lack of flatness of the main middle area of the belt and resulting in cast product issuing from the moving mold having inferior surface finish, and during the treatment the belt is revolved under tension passing against and past at least one relatively small diameter transversely disposed work roller deflecting the course of the tensioned belt for causing inelastic yielding bending elongation of the belt for flattening the belt prior to operation in a moving mold, the improvement in said treatment characterized by:

during said treatment producing greater inelastic yielding elongation in said two marginal areas of the revolving tensioned belt than in said main middle area by work-roller bending stretching of the two marginal areas more than the main middle area for enhancing flatness of the main middle area of the belt when the belt is being revolved under tension travelling through a moving mold and the main middle area is being heated in the moving mold, said treatment producing a residual longitudinal tensile stress in said main middle area and a residual longitudinal compressive stress in said two marginal areas of said casting belt when at temperature equilibrium in the absence of externally applied force, and said differential between said residual longitudinal tensile and compressive stresses being at least 6,000 pounds per square inch of belt cross-sectional area.

2. In the treatment of a wide, thin, endless, flexible, metallic casting belt, the improvement claimed in claim 1, wherein:

subsequent to treatment the belt is released from tension, and in temperature equilibrium at room temperature the two marginal areas of the belt exhibit transverse rippling.

3. In the treatment of a wide, thin, endless flexible, metallic casting belt, the improvement claimed in claim 1, wherein:

subsequent to treatment with the treated belt released from tension and in temperature equilibrium at room temperature the outer surface of the belt has a transverse concave shape.

4. In the treatment of a wide, thin, endless, flexible, metallic casting belt, the improvement claimed in claim 1, including the step of:

passing the revolving tensioned casting belt against and past at least one work roller having an effective hour-glass shape for subjecting said two margins of the belt to a greater tension than said main middle area during work-roller bending stretching of the belt for producing greater inelastic yielding elongation in said two marginal areas of the revolving tensioned belt than in said main middle area.

5. In the treatment of a wide, thin, endless, flexible, metallic casting belt, the improvement claimed in claim 4, wherein:

said hour-glass shaped work roller has two ends and is symmetrical, being contoured with two conically tapered sections enlarging in diameter toward the respective ends of the work roller.

6. In the treatment of a wide, thin, endless, flexible, metallic casting belt, the improvement claimed in claim 5, wherein:

said hour-glass shaped work roller has a central cylindrical section straddled by two conically tapered sections.

7. In the treatment of a wide, thin, endless, flexible, metallic casting belt adapted to be revolved under tension for travelling through a moving mold and having a main middle area for providing a moving wall in the moving mold for continuous casting of hot molten metal in the moving mold, said main middle area being straddled by two marginal areas, and wherein the main middle area of the casting belt becomes heated by the molten metal, causing the main middle area to expand and slacken in the moving mold relative to the two marginal areas, thereby causing lack of flatness of the main middle area of the belt and resulting in cast product issuing from the moving mold having inferior surface finish, and during the treatment the belt is revolved under tension passing against and past at least one relatively small diameter transversely disposed work roller deflecting the course of the tensioned belt for causing inelastic yielding bending elongation of the belt for flattening the belt prior to operation in a moving mold, the improvement in said treatment characterized by:

during said treatment producing greater inelastic yielding elongation in said two marginal areas of the revolving tensioned belt than in said main middle area by work-roller bending stretching of the two marginal areas more than the main middle area sufficiently for enhancing flatness of the main middle area of the belt when the belt is being revolving under tension travelling through a moving mold and the main middle area is being heated in the moving mold, including the step of:

heating the main middle area of the revolving tensioned belt to a higher temperature than said two marginal areas for having a significant differential in temperature between said main middle area and said two marginal areas as the revolving tensioned belt is passing against and past said work roller for producing sufficient differential in inelastic elongation between said main middle area and said two marginal areas for enhancing flatness of the main middle area of the belt when heated in the moving mold, for enhancing surface finish of the product being cast.

8. In treatment of a wide, thin, endless, flexible, metallic casting belt, the improvement claimed in claim 7, including:

heating the main middle area of the revolving tensioned belt to a temperature at least about 65 degrees F. higher than a temperature of said two marginal areas.

9. In the treatment of a wide, thin, endless, flexible, metallic casting belt adapted to be revolved under tension for travelling through a moving mold and having a main middle area for providing a moving wall in the moving mold for continuous casting of hot molten metal in the moving mold, said main middle area being straddled by two marginal areas, and wherein the main middle area of the casting belt becomes heated by the molten metal, causing the main middle area to expand and slacken in the moving mold relative to the two marginal areas, thereby causing lack of flatness of the main middle area of the belt and resulting in cast product issuing from the moving mold having inferior surface finish, and during the treatment the belt is revolved under tension passing against and past at least one relatively small diameter transversely disposed work roller deflecting the course of the tensioned belt for causing inelastic yielding bending elongation of the belt for flattening the belt prior to operation in a moving mold, the improvement in said treatment characterized by:

during said treatment producing greater inelastic yielding elongation in said two marginal areas of the revolving tensioned belt than in said main middle area by work-roller bending stretching of the two marginal areas more than the main middle area sufficiently for enhancing flatness of the main middle area of the belt when the belt is being revolved under tension travelling through a moving mold and the main middle area is being heated in the moving mold, for enhancing surface finish of the product being cast, including the step of:

passing the revolving tensioned casting belt against and past at least one work roller having an effective hour-glass shape for subjecting said two margins of the belt to a greater tension than said main middle area during work-roller bending stretching of the belt for producing greater inelastic yielding elongation in said two marginal areas of the revolving tensioned belt than in said main middle area, said hour-glass shaped work roller having two ends and a center and being symmetrical, being contoured with two conically tapered sections enlarging in diameter toward the respective ends of the work roller, and the effective diameter of each of said two ends being in the range from about 0.06 of an inch to about 0.24 of an inch larger in effective diamter than said center.

10. In the treatment of a wide, thin, endless, flexible, metallic casting belt, the improvement claimed in claim 9, wherein:

subsequent to treatment the intensioned belt in temperature equilibrium at room temperature has a transversely concave-shaped outer surface.

11. In the treatment of a wide, thin, endless, flexible, metallic casting belt adapted to be revolved under tension for travelling through a moving mold and having a main middle area for providing a moving wall in the moving mold for continuous casting of hot molten metal in the moving mold, said main middle area being straddled by two marginal areas, and wherein the main middle area of the casting belt becomes heated by the molten metal, causing the main middle area to expand and slacken in the moving mold relative to the two marginal areas, thereby causing lack of flatness of the main middle area of the belt and resulting in cast product issuing from the moving mold having inferior surface finish, and during the treatment the belt is revolved under tension passing against and past at least one relatively small diameter transversely disposed work roller deflecting the course of the tensioned belt for causing inelastic yielding bending elongation of the belt for flattening the belt prior to operation in a moving mold, the improvement in said treatment characterized by:

during said treatment producing greater inelastic yielding elongation in said two marginal areas of the revolving tensioned belt than in said main middle area by work-roller bending stretching of the two marginal areas more than the main middle area sufficiently for enhancing flatness of the main middle area of the belt when the belt is being revolved under tension travelling through a moving mold and the main middle area is being heated in the moving mold, for enhancing surface finish of the product being cast, and including the steps of:

using a straight cylindrical work roller having an axis, providing pairs of freely rotatable bearing elements for forming a nest for supporting said work roller, and arranging said bearing elements for causing the axis of said work roller to be deflected into a desired hour-glass shape curve as said work roller nests against said bearing elements.

12. In the treatment of a wide, thin, endless, flexible, metallic casting belt, the improvement claimed in claim 11, wherein:

the deflection of the axis of said work roller is in the range from about 0.04 of an inch per foot of axis length to about 0.12 of an inch per foot of axis length.

13. In the treatment of a wide, thin, endless, flexible, metallic casting belt having a main middle area straddled by two marginal areas, wherein the casting belt is revolved under tension passing against and past at least one transversely disposed work roller deflecting the course of the tensioned belt for causing inelastic yielding bending elongation of the casting belt for flattening the belt, the improvement in said treatment characterized by:

producing an in-the-moving-mold-belt-flattening-enhancement-effective amount of differential between residual longitudinal tensile stress in the main middle area of the casting belt and residual longitudinal compressive stress in the two marginal areas of the casting belt, wherein:

subsequent to treatment the untensioned casting belt in temperature equilibrium at room temperature exhibits transverse rippling of the two marginal areas of the casting belt.

14. In the treatment of a wide, thin, endless, flexible, metallic casting belt, the improvement claimed in claim 13, wherein the casting belt has a thickness in the range from about 0.030 of an inch to about 0.080 of an inch, including the step of:

passing the revolving tensioned casting belt against and past at least one work roller having an effective hour-glass shape for subjecting said two margins of the belt to a greater tension than said main middle area during work-roller bending stretching of the belt for producing greater inelastic yielding elongation in said two marginal areas of the revolving tensioned belt than in said main middle area, said work roller being coated with a hard rubber layer having a thickness in the range from about 0.10 of an inch to about 0.40 of an inch.

15. In the treatment of a wide, thin, endless, flexible, metallic casting belt, the improvement claimed in claim 14, wherein:

said hour-glass shaped work roller has two ends and is symmetrical, being contoured with two conically tapered sections enlarging in diameter toward the respective ends of the work roller.

16. In the treatment of a wide, thin, endless, flexible, metallic, casting belt, the improvement claimed in claim 15, wherein:

said hour-glass shaped work roller has a central cylindrical section straddled by said two conically tapered sections.

17. In the treatment of a wide, thin, endless, flexible, metallic casting belt having a main middle area straddled by two marginal areas, wherein the casting belt is revolved under tension passing against and past at least one transversely disposed work roller deflecting the course of the tensioned belt for causing inelastic yielding bending elongation of the casting belt for flattening the belt, the improvement in said treatment characterized by:

producing an in-the-moving-mold-belt-flattening-enhancement-effective amount of differential between residual longitudinal tensile stress in the main middle area of the belt and residual longitudinal compressive stress in the two marginal areas of the belt, including the step of:

during said treatment heating the main middle area of the revolving tensioned belt relative to the two marginal areas for having a significant differential in temperature between said main middle area and said two marginal areas as the revolving tensioned belt is passing against and past said work roller for producing said differential between residual longitudinal tensile stress in said main middle area and residual longitudinal compressive stress in said two marginal areas.

18. In the treatment of a wide, thin, endless, flexible, metallic casting belt, the improvement claimed in claim 17, including the step of:

heating said main middle area of the belt to a temperature at least about 65 degrees F. higher than a temperature of said two marginal areas.

19. In the treatment of a wide, thin, endless, flexible, metallic casting belt, the improvement claimed in claim 17, in which:

the treatment is carried out during use of the casting belt in a casting machine for casting molten metal wherein the casting belt is revolved under tension repeatedly travelling through the casting region as a wall of the moving mold and returning along a return path spaced away from the casting region, said treatment being carried out as the casting belt is returning along the return path.

20. In the treatment of a wide, thin, endless, flexible, metallic casting belt having a main middle area straddled by two marginal areas, wherein the casting belt is revolved under tension passing against and past at least one transversely disposed work roller deflecting the course of the tensioned belt for causing inelastic yielding bending elongation of the casting belt for flattening the belt, the improvement in said treatment characterized by:

producing an in-the-moving-mold-belt-flattening-enhancement-effective amount of differential between residual longitudinal tensile stress in the main middle area of the belt and residual longitudinal compressive stress in the two marginal areas of the belt, including the step of:

passing the revolving tensioned casting belt against and past at least one work roller having an effective hour-glass shape for subjecting said two margins of the belt to a greater tension than said main middle area during work-roller bending stretching of the belt for producing greater inelastic yielding elongation in said two marginal areas of the revolving tensioned belt than in said main middle area, said hour-glass shaped work roller having two ends and a center and being symmetrical, being contoured with two conically tapered sections enlarging in diameter toward the respective ends of the work roller, and the effective diameter of each of said two ends is in the range from about 0.06 of an inch to about 0.24 of an inch larger in effective diameter than said center.

21. In the treatment of a wide, thin, endless, flexible, metallic casting belt having a main middle area straddled by two marginal areas, wherein the casting belt is revolved under tension passing against and past at least one transversely disposed work roller deflecting the course of the tensioned belt for causing inelastic yielding bending elongation of the casting belt for flattening the belt, the improvement in said treatment characterized by:

producing an in-the-moving-mold-belt-flattening-enhancement-effective amount of differential between residual longitudinal tensile stress in the main middle area of the belt and residual longitudinal compressive stress in the two marginal areas of the belt, including the step of:

passing the revolving tensioned casting belt against and past at least one work roller having an effective hour-glass shape for subjecting said two margins of the belt to a greater tension than said main middle area during work-roller bending stretching of the belt for producing greater inelastic yielding elongation in said two marginal areas of the revolving tensioned belt than in said main middle area, including the steps of:

using a straight cylindrical work roller having an axis, providing pairs of freely rotatable bearing elements for forming a nest for supporting said work roller, and arranging said bearing elements for causing the axis of said work roller to be deflected into a desired hour-glass shape curve as said work roller nests against said bearing elements.

22. In the treatment of a wide, thin, endless, flexible, metallic, casting belt, the improvement claimed in claim 21, wherein:

the deflection of the axis of said work roller is in the range from about 0.04 of an inch per foot of axis length to about 0.12 of an inch per foot of axis length.

23. In the treatment of a wide, thin, endless, flexible, metallic, casting belt having a main middle area straddled by two marginal areas, wherein the casting belt is revolved under tension passing against and past at least one transversely disposed work roller deflecting the course of the tensioned belt for causing inelastic yielding bending elongation of the casting belt for flattening the belt, the improvement in said treatment characterized by:

passing the revolving tensioned casting belt against and past at least one work roller having an effective hour-glass shape with two ends and a center for subjecting said two margins of the belt to a greater tension than said main middle area during work-roller bending stretching of the belt for producing greater inelastic yielding elongation in said two marginal areas of the revolving tensioned belt than in said main middle area, the effective diameter of each of said two ends being in the range from about 0.06 of an inch to about 0.24 of an inch larger in effective diameter than said center, and said treatment being carried out during use of the casting belt in a casting machine wherein the casting belt is revolved under tensioned forming a wall of a moving mold for casting molten metal and the treatment is carried out on the revolving casting belt in the casting machine at a location away from the moving mold.

24. In the treatment of a wide, thin, endless, flexible, metallic, casting belt, the improvement claimed in claim 30, wherein:

subsequent to treatment the untensioned belt in temperature equilibrium at room temperature exhibits transverse rippling of the two marginal areas of the belt.

25. A wide, thin, endless, flexible, metallic, casting belt having a main middle area straddled by two marginal areas characterized in that:

said casting belt has an in-the-moving-mold-belt-flattening-enhancement-effective amount of differential between residual longitudinal tensile stress in the main middle area of the casting belt and residual longitudinal compressive stress in the two marginal areas of the casting belt, and said differential is at least 6,000 pounds per square inch of cross-sectional area of the casting belt.

26. A wide, thin, endless, flexible, metallic, casting belt as claimed in claim 25, characterized in that:

said casting belt upon being free of constraint in temperature equilibrium at room temperature exhibits transverse rippling of said two marginal areas of the belt.

27. A wide, thin, endless, flexible, metallic, casting belt as claimed in claim 25, characterized in that:

its outer surface has a transverse concave shape.

28. A wide, thin, endless, flexible, metallic, casting belt for use in a moving mold for continuously casting molten metal into cast product and having a main middle area for constraining metal being cast in the moving mold and having two marginal areas straddling said main middle area, said casting belt being characterized in that:

when said casting belt is in temperature equilibrium at room temperature in the absence of externally applied force, said main middle area has residual longitudinal tensile stress, said two marginal areas each has residual longitudinal compressive tress, thereby providing in said casting belt a differential between said residual longitudinal tensile and compressive stresses, and said differential is at least 6,000 pounds per square inch of cross-sectional area of the belt.

29. The method of operating a twin-belt continuous casting machine having two revolving wide, thin, endless, flexible, metallic casting belts moving in spaced opposed relationship forming a moving mold having an entrance for admitting molten metal and an exit for discharging cast product, each of said belts having a main middle area for constraining metal being cast in the moving mold and each having two marginal areas straddling said main middle area, and wherein each of the revolving casting belts returns from the exit to the entrance of the moving mold along a return path spaced away from the moving mold, said method comprising the steps of:

placing at least one of the revolving casting belts under tension in the range from about one-twentieth to about one-half of the ultimate yield stress of said casting belt, said casting belt being formed of metal having an ultimate yield stress in the range from about 35,000 to about 80,000 pounds per square inch.

during the return of said casting belt moving said casting belt against and past two work rollers each transversely disposed to said casting belt and located on opposite sides of the belt in staggered relationship for deflecting said casting belt from a straight path in one direction and then in the other direction for work-roller stretching said belt beyond the ultimate yield stress of said metal, during the return of the belt prior to the belt contacting said two work rollers heating the main middle area of the belt relative to the two marginal areas for expanding and slackening the main middle area of the belt moving against and past said work rollers for work-roller stretching said two margins more than said main middle area, and said method thereby causing said casting belt in said moving mold upon said main middle area becoming heated and expanded by heat from the metal being cast to experience improved uniformity of tension in said main middle area and in said two marginal areas as compared with a prior art casting belt not using said method and being of the same size and same metal in a moving mold of the same size casting the same metal, for producing cast product having enhanced surface finish as compared with said prior art casting belt not using said method.

30. In the treatment of a wide, thin, endless, flexible, metallic, casting belt having a main middle area straddled by two marginal areas, wherein the casting belt is revolved under tension passing against and past at least one transversely disposed work roller deflecting the course of the tensioned belt for causing inelastic yielding bending elongation of the casting belt for flattening the belt, the improvement in said treatment characterized by:

producing a continuously-cast-product-surface-finish-enhancement-effective amount of differential between residual longitudinal tensile stress in the main middle area of the belt and residual longitudinal compressive stress in the two marginal areas of the belt, including the step of:

during said treatment heating the main middle area of the revolving tensioned belt relative to the two marginal areas for having a significant differential in temperature between said main middle area and said two marginal areas as the revolving tensioned belt is passing against and past said work roller for producing said differential between residual longitudinal tensile stress in said main middle area and residual longitudinal compressive stress in said two marginal areas.

31. The method of operating a twin-belt continuous casting machine having two revolving wide, thin, endless, flexible, metallic casting belts moving in spaced opposed relationship forming a moving mold having an entrance for admitting molten metal and an exit for discharging cast product, each of said belts having a main middle area for constraining metal being cast in the moving mold and each having two marginal areas straddling said main middle area, and wherein each of the revolving casting belts returns from the exit to the entrance of the moving mold along a return path spaced away from the moving mold, said method comprising the steps of:

placing at least one of the revolving casting belts under tension in the range from about one-twentieth to about one-half of the ultimate yield stress of said casting belt, said casting belt being formed of metal having an ultimate yield stress in the range from about 35,000 to about 80,000 pounds per square inch, during the return of said casting belt having said casting belt against and past at least one work roller transversely disposed to said casting belt deflecting said casting belt from a straight path for work-roller stretching said belt beyond the ultimate yield stress of said metal, differentially stretching said two margins of said belt more than said main middle area, and thereby causing said casting belt in said moving mold upon said main middle area becoming heated and expanded by heat from the metal being cast to experience improved uniformity of tension in said main middle area and in said two marginal areas as compared with a prior art casting belt of the same size and same metal in a moving mold of the same size casting the same metal for producing cast product having enhanced surface finish, said method including the step of:

heating the main middle area of the belt during return of the belt and prior to the belt contacting said work roller for expanding and slackening the main middle area of the belt moving against and past said work roller for work-roller stretching said two margins more than said main middle area.

* * * * *